US009534448B2

(12) United States Patent
Da Silva et al.

(10) Patent No.: US 9,534,448 B2
(45) Date of Patent: Jan. 3, 2017

(54) UNBALANCE FORCE IDENTIFIERS AND BALANCING METHODS FOR DRILLING EQUIPMENT ASSEMBLIES

(71) Applicant: Halliburton Energy Services, Inc., Houston, TX (US)

(72) Inventors: Nuno Da Silva, Brussels (BE); Olivier Dupont, St. Ghislain (BE); Olivier Mageren, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

(21) Appl. No.: 14/379,136

(22) PCT Filed: Oct. 31, 2013

(86) PCT No.: PCT/US2013/067688

§ 371 (c)(1),
(2) Date: Aug. 15, 2014

(87) PCT Pub. No.: WO2015/065410

PCT Pub. Date: May 7, 2015

(65) Prior Publication Data

US 2016/0237751 A1 Aug. 18, 2016

(51) Int. Cl.
*E21B 7/28* (2006.01)
*E21B 10/26* (2006.01)
(Continued)

(52) U.S. Cl.
CPC . *E21B 7/28* (2013.01); *E21B 3/00* (2013.01); *E21B 7/24* (2013.01); *E21B 10/26* (2013.01); *E21B 10/42* (2013.01)

(58) Field of Classification Search
CPC ..... E21B 7/28; E21B 10/42; E21B 10/26; E21B 7/10; E21B 47/02; E21B 47/09
See application file for complete search history.

(56) References Cited

U.S. PATENT DOCUMENTS 4,982,802 A * 1/1991 Warren ..... E21B 7/04 175/325.1
5,678,644 A * 10/1997 Fielder ..... E21B 10/26 175/391

(Continued)

FOREIGN PATENT DOCUMENTS

EP 1085167 A2 3/2001
GB 2351513 A 1/2001

(Continued)

OTHER PUBLICATIONS

Barton et al., "True Matching of Bit and Multidiameter String Tools Delivers Optimized Drilling Performance," SPE/IADC 118298, 2009.

(Continued)

*Primary Examiner* — Nicole Coy
(74) *Attorney, Agent, or Firm* — McDermott Will & Emery LLP; Alan Bryson

(57) ABSTRACT

A described bottom hole assembly includes a drill bit arranged at a distal end of a drill string and rotatable about a first central axis, the drill bit exhibiting a first unbalance force acting laterally on the drill bit at a first angular orientation, a first unbalance force marking physically applied to the drill bit and corresponding to the first unbalance force, a tool arranged axially from the drill bit, the tool exhibiting a second unbalance force acting laterally on the tool at a second angular orientation, and a second unbalance force marking physically applied to the tool and corresponding to the second unbalance force, wherein an angular offset between the first and second unbalance forces markings is able to be manipulated in order to obtain a minimized or desired tandem resulting unbalance force.

20 Claims, 4 Drawing Sheets

(51) Int. Cl.

| | |
|---|---|
| ***E21B 10/42*** | (2006.01) |
| ***E21B 3/00*** | (2006.01) |
| ***E21B 7/24*** | (2006.01) |

(56) References Cited

U.S. PATENT DOCUMENTS

| | | | | |
|---|---|---|---|---|
| 5,957,223 | A * | 9/1999 | Doster | E21B 10/26 175/385 |
| 6,039,131 | A | 3/2000 | Beaton | |
| 6,708,782 | B1 * | 3/2004 | Turney | E21B 7/067 175/40 |
| 6,729,420 | B2 * | 5/2004 | Mensa-Wilmot | E21B 10/26 175/327 |
| 6,913,098 | B2 * | 7/2005 | Fielder | E21B 10/43 175/385 |
| 7,958,953 | B2 | 6/2011 | Chafai | |
| 8,631,883 | B2 * | 1/2014 | Dourfaye | E21B 10/42 175/293 |
| 8,720,611 | B2 * | 5/2014 | Chen | E21B 10/43 175/327 |
| 8,899,357 | B2 * | 12/2014 | Chen | E21B 10/43 175/331 |
| 9,115,552 | B2 * | 8/2015 | Chen | E21B 10/43 |
| 2003/0070844 | A1 | 4/2003 | Radzinski et al. | |
| 2008/0230273 | A1 | 9/2008 | Brooks | |
| 2012/0255780 | A1 | 10/2012 | Schmidt | |
| 2012/0303279 | A1 | 11/2012 | Firmin | |
| 2014/0278282 | A1 * | 9/2014 | Chen | E21B 10/43 703/1 |
| 2015/0363523 | A1 * | 12/2015 | Chen | E21B 10/43 703/7 |

FOREIGN PATENT DOCUMENTS

| | | | |
|---|---|---|---|
| WO | 2012112155 | A1 | 8/2012 |
| WO | 2015065410 | A1 | 5/2015 |

OTHER PUBLICATIONS

International Search Report and Written Opinion for PCT/US2013/67688 dated Jul. 21, 2014.

* cited by examiner

UNBALANCE FORCE IDENTIFIERS AND BALANCING METHODS FOR DRILLING EQUIPMENT ASSEMBLIES

BACKGROUND

The present disclosure relates to earth penetrating drilling equipment and, more particularly, to physically marking drilling equipment and drilling equipment assemblies such that tandem drilling components may be intelligently coupled.

Wellbores are formed in subterranean formations for various purposes including, for example, the extraction of oil and gas and the extraction of geothermal heat. Such wellbores are typically formed using one or more drill bits, such as fixed-cutter bits (i.e., drag bits), roller-cone bits (i.e., rock bits), diamond-impregnated bits, and hybrid bits, which may include, for example, both fixed cutters and rolling cutters. The drill bit is coupled either directly or indirectly to an end of a drill string, which encompasses a series of elongated tubular segments connected end-to-end that extends into the wellbore from a surface location. Various tools and components, including the drill bit, are often arranged or otherwise coupled at the distal end of the drill string at the bottom of the wellbore. This assembly of tools and components is commonly referred to as a bottom hole assembly (BHA).

In order to form the wellbore, the drill bit is rotated and its associated cutters or abrasive structures cut, crush, shear, and/or abrade away the formation materials, thereby facilitating the advancement of the drill bit into subterranean formations. In some cases, the drill bit is rotated within the wellbore by rotating the drill string from the surface while drilling fluid is pumped from the surface to the drill bit. The drilling fluid exits the drill string at the drill bit and serves to cool the drill bit and flush drilling particulates back to the surface. In other cases, however, the drill bit may be rotated using a downhole motor (e.g., a mud motor) powered by the drilling fluid pumped from the surface.

To enlarge the diameter of the wellbore, a reamer device (also referred to as a hole opening device or a hole opener) may be used in conjunction with the drill bit as part of the BHA. The reamer is typically axially-offset uphole from the drill bit along the length of the BHA and exhibits a diameter greater than that of the drill bit. While typically arranged concentric with the drill bit, some reamers can be radially offset from the drill bit. Reamers can also be of fixed or variable geometry. In operation, the drill bit operates as a pilot bit to form a pilot bore in the subterranean formation, and the reamer follows the drill bit through the pilot bore to enlarge the diameter of the wellbore as the BHA advances into the formation.

Each of these drilling components (i.e., the drill bit and the reamer) can be designed to have as little cutting and mass imbalance forces as possible, since such imbalances can result in inefficient drilling and unwanted vibration propagating through the drill string during drilling. These imbalance forces include a component force that urges each drilling component laterally during drilling, thereby resulting in lateral vibrations. While the design of each drilling component endeavors to minimize these unbalance forces, such imbalances are present in practically all drill bits and reamers. When such drilling components are used in tandem along the BHA, their respective unbalanced forces can cooperatively amplify the vibrations in the drill string, thereby further reducing drilling efficiencies and potentially increasing equipment damage.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to earth penetrating drilling equipment and, more particularly, to physically marking drilling equipment and drilling equipment assemblies such that tandem drilling components may be intelligently coupled.

The present disclosure enables well operators in the field to rapidly identify the angular orientation of unbalance forces corresponding to at least two drilling tools or drilling components arranged in a tandem relationship along a bottom hole assembly. Knowing these angular orientations will allow well operators to properly orient the drilling tools or components such that the tandem unbalance force that acts on the bottom hole assembly may be angularly oriented or otherwise minimized. The unbalance forces may be indicated on each drilling tool or component using corresponding unbalance force markings that are physically applied to the outer surface of the drilling tool or component. Accordingly, a well operator in the field may be able to selectively pair drilling tools and/or components in accordance with their corresponding unbalance forces as indicated by the unbalance force markings. As a result, the well operator may be able to intelligently choose which drilling tools and/or components will work best in a tandem arrangement in the bottom hole assembly and orient them relative to each other, thereby allowing tandem balancing and improved drilling performance.

Figure 1:
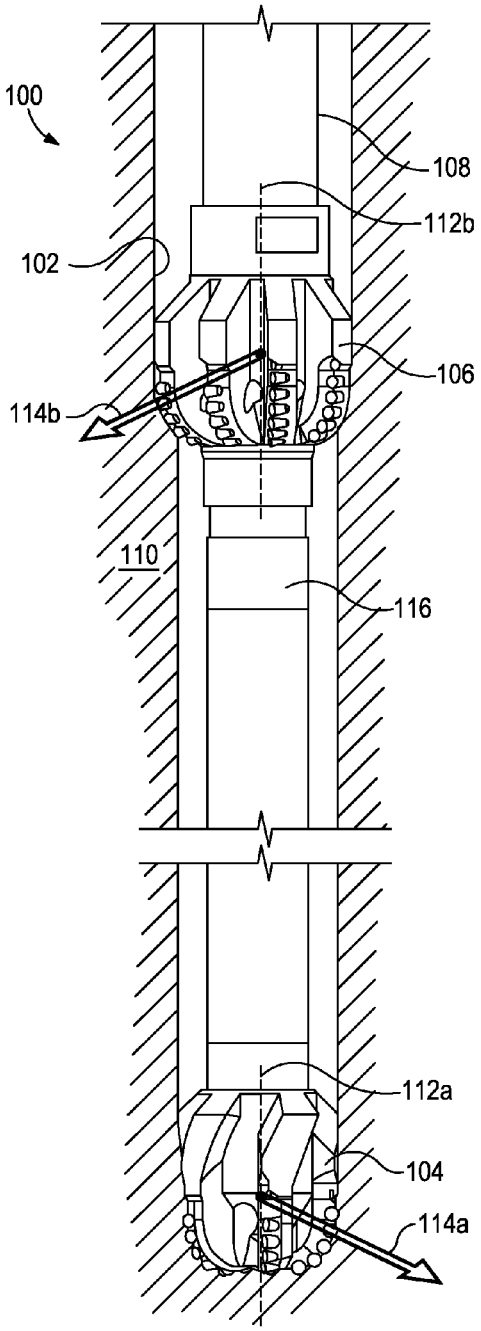
FIG. 1 is an elevational view of an exemplary bottom hole assembly lowered into a representative wellbore, according to one or more embodiments.

FIG. 1 is an elevational view of an exemplary bottom hole assembly (BHA) 100 as lowered into a representative wellbore 102, according to one or more embodiments. As illustrated, the BHA 100 may include one or more drilling components or cutting tools, shown as a drill bit 104 and a reamer 106. The drill bit 104 and the reamer 106 may be arranged in a tandem relationship being axially spaced from each other along a drill string 108 that extends from a surface location (not shown). The drill bit 104 and the reamer 106 may be configured to drill or otherwise cut into a subterranean formation 110 to form the wellbore 102 for the purposes of extracting hydrocarbons from the subterranean formation 110.

As the drill string 108 advances the BHA 100 into the subterranean formation 110, the drill bit 104 may form the wellbore 102 at a first diameter, and the reamer 106 may follow behind the drill bit 104 to expand the size of the wellbore to a second diameter, where the second diameter is greater than the first diameter. The BHA 100 may be rotated within the wellbore by, for example, rotating the drill string 108 from the surface. As a result, the drill bit 104 may be configured to rotate about its central axis 112*a*, and the reamer may be configured to rotate about its central axis 112*b*. In other embodiments, however, a downhole motor within the BHA (not shown) may otherwise be used to rotate the BHA 100, without departing from the scope of the disclosure.

While not specifically illustrated or described herein, the BHA 100 may further include various other types of drilling tools or components such as, but not limited to, a steering unit, one or more stabilizers, one or more mechanics and dynamics tools, one or more drill collars, one or more accelerometers, one or more jars, one or more sensors or sensor subs, and one or more heavy weight drill pipe segments.

The drill bit 104 may be any type of bit known to those skilled in the art. In some embodiments, for example, the drill bit 104 may be a fixed-cutter drill bit having a plurality of polycrystalline diamond cutters (PDC). Likewise, the reamer 106 may be any type of reamer known to those skilled in the art, such as a fixed size concentric reamer, a variable geometry concentric or eccentric reamer, a bi-center reamer, or a roller-reamer. As the drill bit 104 and the reamer 106 rotate during drilling operations, each impinge upon the underlying rock of the subterranean formation 110 with a given axial force and torque. As a result, unbalance cutting reaction forces including a lateral component (shown as cutting lateral reaction forces 114*a* and 114*b* for the drill bit 104 and the reamer 106, respectively) may be generated and act on the corresponding cutting tool. More particularly, the lateral component of the cutting reaction forces 114*a,b* may be unbalanced, thereby urging the drill bit 104 and the reamer 106, respectively, in corresponding lateral directions at particular angular orientations with respect to their corresponding central axes 112*a,b*. In some embodiments, as will be described below with reference to FIGS. 2A and 2B, the lateral cutting reaction unbalance forces 114*a,b* may be characterized as unbalanced forces on the drill bit 104 and/or the reamer 106. In other embodiments, however, the lateral cutting unbalance forces 114*a,b* may be derived from mass imbalances relating to each of the cutting tools. Because of such lateral unbalance forces 114*a,b* (cutting and/or mass), unwanted vibration or other inefficiencies may be introduced into the BHA 100, thereby reducing the effectiveness of the drilling operation and potentially damaging elements of the drill string 108.

Figure 2A:
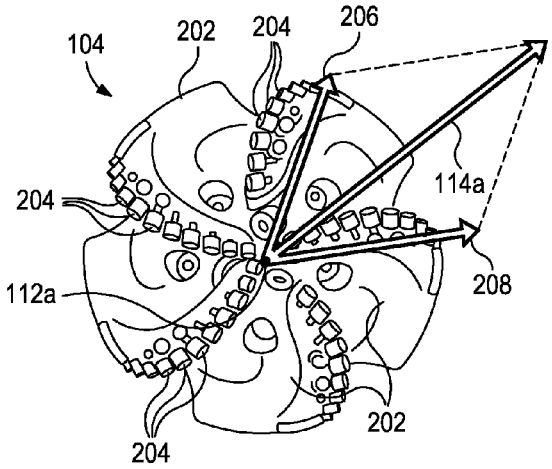
FIG. 2A illustrates an end view of a drill bit showing unbalance force components, as well as the resulting unbalance force related thereto, according to one or more embodiments.

Referring now to FIG. 2A, with continued reference to FIG. 1, illustrated is an end view of the drill bit 104. As illustrated, the drill bit 104 may include a plurality of blades 202 with several cutters 204 coupled or otherwise secured to each blade 202. During operation, the drill bit 104 rotates about its central axis 112*a* and the cutters 204 are configured to contact and cut the rock of the formation 110 (FIG. 1) in order to advance the drill bit 104 therethrough. As the drill bit 104 cuts through the rock, a cutting reaction unbalanced force can result in a lateral component (shown here as the reaction force 114*a*), which unbalances the drill bit and acts perpendicularly to the drill bit central axis 112*a*. The unbalanced force 114*a* may be calculated or otherwise estimated during the design phase for the drill bit 104.

During the design of the drill bit 104, for example, various design parameters are entered into a design software program configured to generate a design model of the drill bit 104. The design software program may be a computer program stored on a non-transitory, computer-readable medium that contains program instructions configured to be executed by one or more processors of a computer system (not shown). The unbalanced force 114*a* for the drill bit 104 can be calculated by taking into account the design parameters of the bit 104. Such design parameters may include, but are not limited to, the geometry of the bit 104 (e.g., diameter, profile, number and shape of the blades 202, etc.), the number, sizes, angles, and placement of the cutters 204, and the types of materials used to manufacture the drill bit 104. Once all the design parameters are entered into the design software computer program, a design model of the drill bit 104 is generated and the unbalanced force 114*a* may be determined from the model.

More specifically, two component force vectors (shown as a radial force 206 and a drag force 208) may be determined or otherwise quantified for the drill bit 104, as based on the inputted design parameters. The radial force 208 is a lateral force that acts on the drill bit 104 during rotation, and the drag force 210 is the reaction force of the underlying rock of the formation 110 (FIG. 1) that generally counteracts the rotation of the bit 104. The resulting unbalanced force 114*a* may be obtained by combining these two force vectors 206, 208, and may represent a resultant lateral force that acts on the drill bit 104 at a particular angular orientation perpendicular to the central axis 112*a*. During operation, the unbalanced force 114*a* will have the tendency to urge the drill bit 104 laterally in the particular angular direction.

In some embodiments, as discussed above, the radial and drag forces 206, 208 may be calculated for each cutter respectively, and subsequently added up to obtain the overall radial and drag forces 206, 208 acting on the drill bit 104 as a whole and the unbalanced force 114*a* may be determined therefrom. More specifically, for each cutter 204 there is a determinable reaction force applied from the rock to the respective cutter 204. To determine these reaction forces for each cutter 204, the design software may take into account various parameters of the cutter 204, such as diameter, angular orientation as attached to the drill bit 104, materials used to make the cutters 204, and other parameters. Individual radial and drag forces may then be calculated for each cutter 204 and these forces may be added or otherwise combined in order to obtain the overall radial and drag forces 206, 208 for the drill bit 104 from which the lateral component unbalanced force 114*a* may be determined.

Figure 2B:
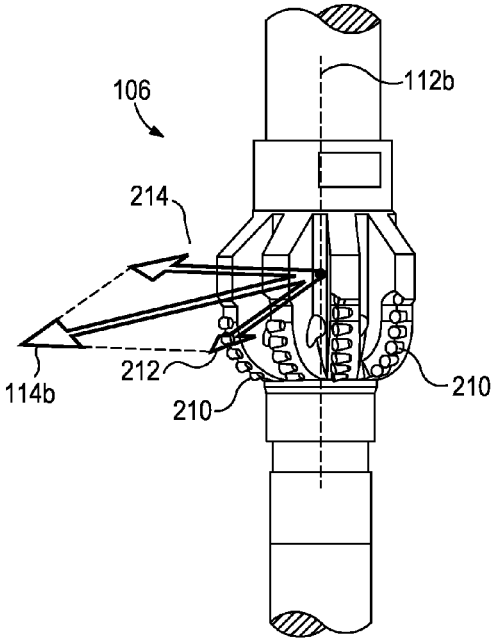
FIG. 2B illustrates a side view of a reamer showing unbalance force components, as well as the resulting unbalance force related thereto, according to one or more embodiments.

Referring to FIG. 2B, similar calculations may be made for the reamer 106 such that a cutting reaction unbalanced force (shown here as reaction force 114*b*) may also be determined for the reamer 106. In particular, illustrated is the reamer 106, which may include one or more radially extending blades or cutters 210. The reamer 106 is designed to rotate about its central axis 112*b* and, during operation, the cutters 210 are configured to contact and cut the rock contained within the formation 110 (FIG. 1) in order to advance the reamer 106 therethrough at a diameter greater than that of the drill bit 104 (FIG. 2A). As the reamer 106 cuts through the rock, the cutting reaction unbalanced force

114*b* may be generated and act on the reamer 106 in a particular direction that is perpendicular to the central axis 112*b*.

The angular orientation and intensity of the cutting reaction unbalanced force 114*b* may be calculated or otherwise estimated during the design phase for the reamer 106. More particularly, the design software may be configured to take into account various design parameters for the reamer 106 and generate a corresponding design model from which the cutting reaction unbalanced force 114*b* may be determined. More specifically, two component force vectors (shown as a radial force 212 and a drag force 214) may be determined or otherwise quantified for the reamer 106 as based on the inputted design parameters. The radial and drag forces 212, 214 may act on the reamer 106 similar to how the radial and drag forces 208, 210 act on the drill bit 104 during rotation, and the cutting reaction unbalanced force 114*b* may be obtained by combining these two force vectors 212, 214. The lateral component of the cutting reaction unbalanced force 114*b* represents a resultant lateral force that acts on the reamer 106 at a particular angular orientation perpendicular to the central axis 112*b*. During operation, the cutting reaction unbalanced force 114*b* will tend to urge the reamer 106 laterally in the particular angular direction resulting from the combination of the radial and drag forces 212, 214.

Referring again to FIG. 1, the drill bit 104 and the reamer 106 are coupled together in a tandem relationship along the BHA 100. This is typically done with complimentary threaded attachments or engagements where each of the drill bit 104 and the reamer 106 may be threadably coupled to the BHA 100 at their respective locations. Once torqueing the threaded engagement of each cutting tool ceases, the angular orientation of the corresponding unbalance forces 114*a,b* (e.g., cutting reaction unbalanced forces, mass imbalance forces, etc.) with respect to the BHA 100 is set. In some cases, for example, the angular orientation of the unbalance forces 114*a,b* may be generally opposite one another, thereby resulting in somewhat of a cancelling effect between the two unbalance forces 114*a,b* as felt by the BHA 100. In other embodiments, however, the angular orientation of the unbalance forces 114*a,b* may be substantially aligned, which may have the effect of combining or otherwise adding the unbalance forces 114*a,b* as felt by the BHA 100. This type of unbalance forces alignment in the BHA can have an interest for directional drilling control, for example.

In the illustrated embodiment of FIG. 1, the angular orientation of the unbalance forces 114*a,b* are not aligned nor are they opposite each other. Rather the first unbalance force 114*a* is angularly offset from the second unbalance force 114*b*. As will be appreciated, the angular offset between the first and second unbalance forces 114*a,b* can range anywhere from 0° to 180°. Depending on the angular offset between the first and second unbalance forces 114*a,b*, and their corresponding intensities, the BHA 100 may experience increased or decreased vibrations or inefficiencies.

According to the present disclosure, the adverse effects derived from the unbalance forces 114*a,b* being angularly offset may be mitigated or otherwise minimized by manipulating such angular orientations after or while the cutting tool is being coupled to (i.e., threadably engaged) the BHA 100. To accomplish this, in at least one embodiment, one or both of the drill bit 104 and the reamer 106 may be arranged on or otherwise include a free-lock system (not shown). Briefly, the free-lock system allows the particular cutting tool (i.e., the drill bit 104 or the reamer 106) to briefly disengage from the drill string 108 such that it may be angularly rotated about its central axis 112*a,b* until locating a desired angular direction or orientation. Once this desired angular orientation is obtained, the free-lock system may then be actuated to re-engage the cutting tool back to the drill string 108 such that simultaneous rotation is again enabled.

In one embodiment, for example, the free-lock system may comprise or otherwise include a flute/spline transmission system, where mating flutes and splines are defined on opposing inner/outer surfaces of the cutting tool. By axially disengaging the flute/spline interface, the cutting tool may be angularly rotated to a desired orientation, and then axially re-engaged so that the flute/spline interface may once again transmit rotational energy across the cutting tool. In other embodiments, the free-lock system may include a clutch system, such as a wedge or friction cone system. In such embodiments, mating wedges may be defined on opposing inner/outer surfaces of the cutting tool. Once the cutting tool is angularly rotated to a desired orientation, the opposing wedges may be forced into frictional engagement such that the wedge engagement interface is able to transmit rotational energy across the cutting tool.

In other embodiments, the BHA 100 may further include an actuation mechanism or device 116 generally arranged in the drill string 108 between the drill bit 104 and the reamer 106, according to one or more embodiments. The actuation device 116 may be any mechanical, electromechanical, hydraulic, or pneumatic actuator or motor configured to adjust the angular orientation of the drill bit 104 with respect to the reamer 106. In at least one embodiment, the actuation device 116 may be a type of ratcheting device configured to engage and disengage the drill string 108 such that the angular orientation of the drill bit 104 may be manipulated. In other embodiments, the actuation device 116 may be similar to the flute/spline transmission system or the clutch system (e.g., wedge or friction cone system) generally described above. In embodiments where the actuation device 116 is a clutch system, the clutching action may be controlled, for example, by electronics such that a precise angular orientation may be achieved. Alternatively, or in addition thereto, the clutch system may encompass or otherwise include a taper holder system, such as those used in milling machines, where mating wedges or cones are compressed against each other by an electronic device or a mechanical system.

Figure 3:
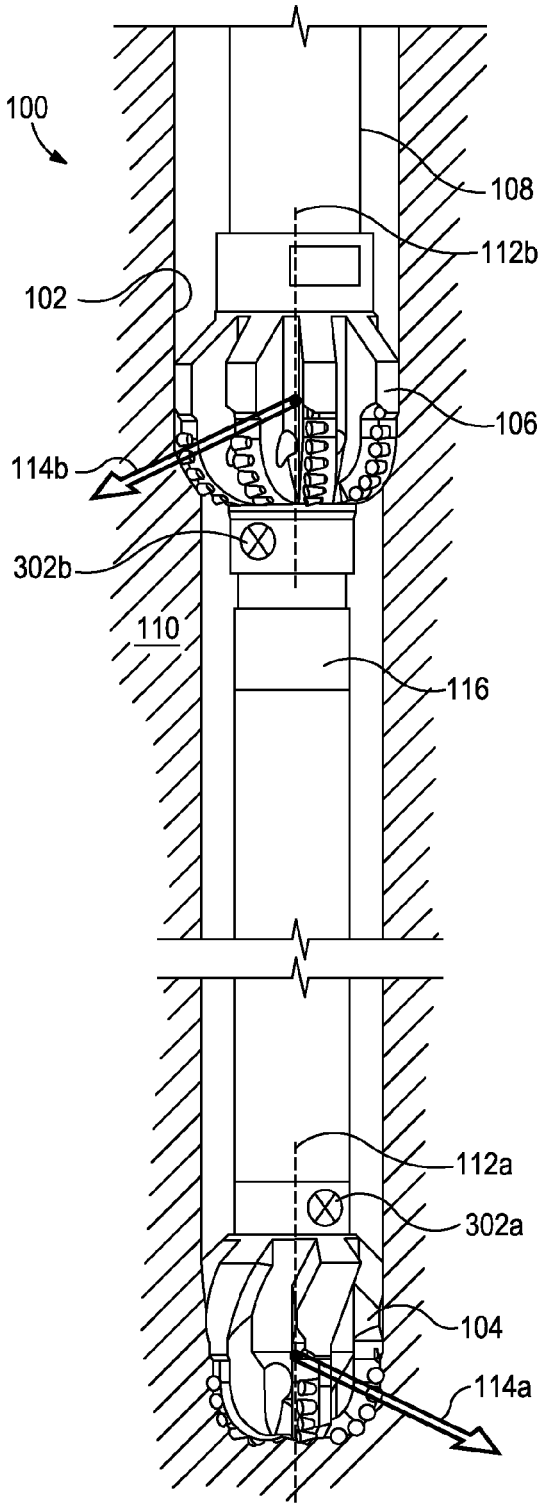
FIG. 3 illustrates an elevational view of the bottom hole assembly of FIG. 1 as exhibiting unbalance forces and angular markings on the drill bit and the reamer, according to one or more embodiments.

Referring now to FIG. 3, with continued reference to FIGS. 1 and 2A-2B, illustrated is the exemplary BHA 100 exhibiting differing angular orientations of the drill bit 104 and the reamer 106, according to one or more embodiments. In order to enable rapid identification in the field of the particular angular orientation of the respective unbalance forces 114*a,b* (e.g., cutting and/or mass unbalance force), each of the drill bit 104 and the reamer 106 may include corresponding force markings (shown as unbalance forces orientation markings 302*a* and 302*b*) physically placed thereon. The first unbalance force marking 302*a* corresponds to the angular orientation of the unbalance force 114*a* of the drill bit 104, and the second unbalance force marking 302*b* corresponds to the angular orientation of the unbalance force 114*b* of the reamer 106. As discussed above, such angular orientations for the unbalance forces 114*a,b* may be determined during the design phase of each cutting tool, and the unbalance force markings 302*a,b* may be physically applied to each cutting tool during the manufacturing stage.

In some embodiments, the unbalance force markings 302*a,b* may be machined into the outer surface of one or both of the drill bit 104 and the reamer 106. In other embodiments, the unbalance force markings 302*a,b* may be welded to or otherwise cast into the body of each of the drill bit 104 and reamer 106. In yet other embodiments, the unbalance force markings 302*a,b* may take the form of a sticker, a plastic or metal information plate, or another identifier that may be physically adhered, coupled, or otherwise attached to the outer surface of each of the drill bit 104 and reamer 106, respectively.

As will be appreciated, the design or configuration of the unbalance force markings 302*a,b* may take on several different forms. In the illustrated embodiment, the unbalance force markings 302*a,b* may include at least a target circle, for example, which may be representative of the particular angular orientation of the unbalance force 114*a,b*. In other words, the target circle indicates the direction in which the lateral component of the unbalance force 114*a,b* extends perpendicularly from the central axis 112*a,b*, respectively, and radially out of the center of the target circle. This is the angular direction in which the unbalance force 114*a,b* will tend to urge its corresponding cutting tool laterally during operation. The angular orientation of the unbalance force marking 302*a,b* allows the operator to angularly align (or misalign) the cutting tools using the target circles in order to minimize or maximize the resulting addition of each unbalance force 114*a,b*.

In some embodiments, the unbalance force markings 302*a,b* may have text written thereon, such as within or without the target circle. The text may identify or otherwise indicate what the unbalance force markings 302*a,b* represent. For instance, in some embodiments, the unbalance force markings 302*a,b* may have "CUF" written thereon indicating that the unbalance force markings 302*a,b* correspond to the angular orientation of the cutting unbalance force of the corresponding cutting tool. In other embodiments, the unbalance force markings 302*a,b* may have "MUF" written thereon indicating that the unbalance force markings 302*a,b* correspond to the angular orientation of the mass unbalance force of the corresponding cutting or non-cutting tool. It will be appreciated that the unbalance force markings 302*a,b* may have any text or markings thereon such that a well operator is able to easily identify what unbalance force 114*a,b* the particular unbalance force marking 302*a,b* corresponds to.

In yet other embodiments, the unbalance force markings 302*a,b* may further include text providing the calculated intensity or relative value of the unbalance force 114*a,b*. In the case of cutting reaction unbalance forces, this may take the form of a percentage of weight-on-bit or weight-on-reamer. In other embodiments, such as when the unbalance forces 114*a,b* correspond to a mass unbalance, the unbalance force markings 302*a,b* may include text related to centrifugal forces for given rotational speeds.

Figure 4A:
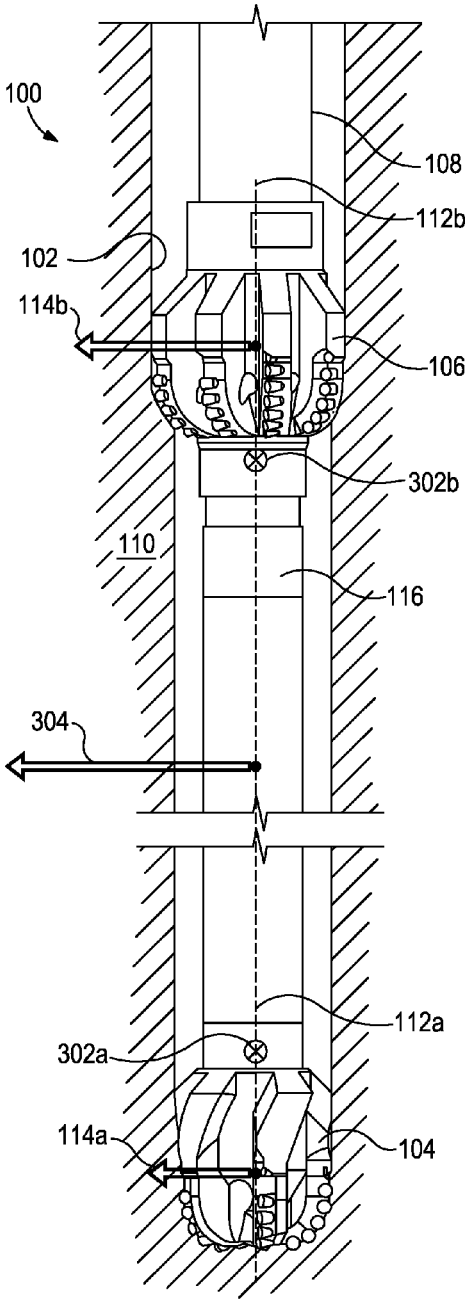
FIGS. 4A and 4B illustrate elevational views of the bottom hole assembly of FIG. 1 as exhibiting differing relative angular orientations of the drill bit and the reamer unbalance forces, according to one or more embodiments.
Figure 4B:
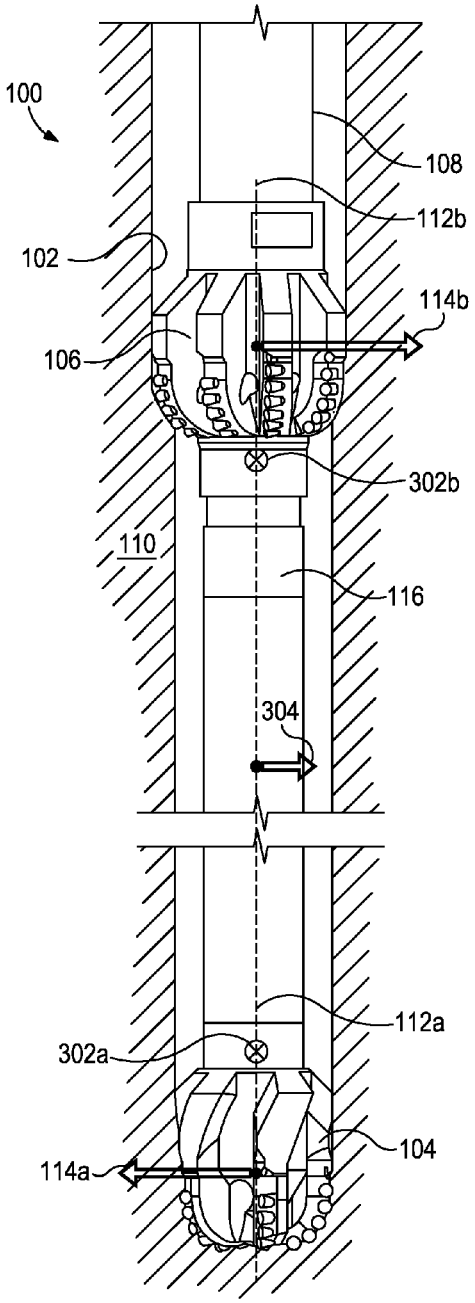

Referring now to FIGS. 4A and 4B, illustrated are elevational views of the bottom hole assembly 100 as exhibiting differing relative angular orientations of the unbalance forces 114*a,b* corresponding to the drill bit 104 and the reamer 106, respectively, according to one or more embodiments. As will be appreciated, the unbalance force markings 302*a,b* may prove useful in enabling well operators in the field to rapidly identify the angular orientation of the unbalance forces 114*a,b* for the drill bit 104 and the reamer 106, respectively. Knowing these angular orientations will further allow well operators to properly orient the drill bit 104 with respect to the reamer 106 once each is attached to the drill string 108, and thereby tailor a tandem unbalance force 304 that acts on the BHA 100 as a whole. As described above, manipulation of the angular orientation of the unbalance forces 114*a,b* may be done either using corresponding free-lock systems associated with one or both of the drill bit 104 and the reamer 106 or with the actuation device 116.

As shown in FIG. 4A, for example, the unbalance forces 114*a,b* of the drill bit 104 and the reamer 106 may be generally aligned. For illustrative purposes of the description, the unbalance forces 114*a,b* are shown extending orthogonally to the left of the central axes 112*a,b*. As described above, however, such unbalance forces 114*a,b* actually extend orthogonally out of the page. By angularly aligning (or substantially aligning) the unbalance forces 114*a,b*, the tandem reaction force 304 acting on the BHA 100 may be maximized as a sum of the unbalance forces 114*a,b*. Such an embodiment may prove useful in directional drilling applications where the maximized tandem unbalance force 304 provides an induced bending moment in the drill string 108 that may support directional cutting tools used in the BHA 100.

In other embodiments, however, it may be desired to place the unbalance forces 114*a,b* angularly opposite from each other, such as is shown in FIG. 4B. As illustrated, the second unbalance force 114*b* is angularly opposite the first unbalance force 114*b* (i.e., 180° angular offset), as indicated by the phantom second unbalance force marking 302*b* corresponding to the second unbalance force 114*b*. Again, for illustrative purposes of the description, the unbalance forces 114*a,b* are shown extending orthogonally to the left and right of the central axes 112*a,b*, respectively. As described above, however, such unbalance forces 114*a,b* actually extend orthogonally out of and into the page, respectively. Such an embodiment may prove useful in minimizing the tandem reaction force 304 acting on the BHA 100. More particularly, with the unbalance forces 114*a,b* acting in opposing angular directions, they may effectively cancel or negate each other, thereby resulting in a smaller tandem unbalance force 304 acting on the BHA 100.

In yet other embodiments, it may be desired to place the unbalance forces 114*a,b* at an angular offset from each other somewhere between angularly aligned and angularly opposite. More specifically, a well operator may desire to place the unbalance forces 114*a,b* at an angular offset falling at a particular angle between 0° and 180°, without departing from the scope of the disclosure.

Accordingly, in the field, drill bits 104 and reamers 106 may be selected and paired together by a well operator in accordance with the respective unbalance forces 114*a,b* as indicated by the corresponding unbalance force markings 302*a,b*. As a result, the well operator may be able to intelligently choose which drill bits 104 and reamers 106 will work best in a tandem arrangement in the BHA 100 to achieve a desired purpose. Moreover, as briefly mentioned above, the unbalance forces 114*a,b* may be indicative of several types of induced lateral unbalance forces that may act on the cutting tools. For example, embodiments of the present disclosure may be useful in minimizing tandem unbalance forces 304 stemming from the mass imbalances on the cutting tools or the combination of cutting reaction unbalance force and mass unbalance force.

Figure 5:
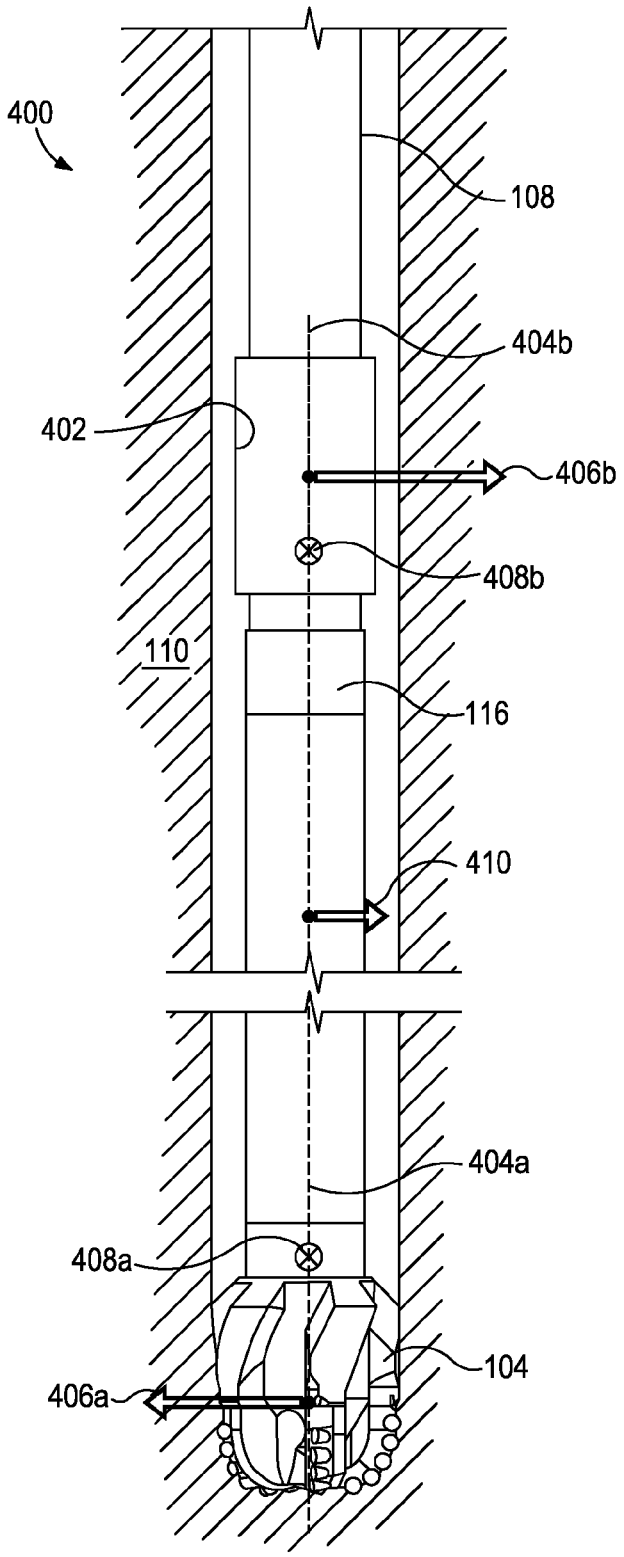
FIG. 5 is an elevational view of another exemplary bottom hole assembly that may employ the principles of the present disclosure, according to one or more embodiments.

Referring now to FIG. 5, illustrated is an elevational view of another exemplary BHA 400 that may employ the principles of the present disclosure, according to one or more embodiments. The BHA 400 may be similar in some respects to the BHA 100 of FIGS. 1, 3, and 4A-4B and therefore will be best understood with reference thereto, where like numerals represent like components not described again in detail. As illustrated, the BHA 400 may be lowered into the wellbore 102 on the drill string 108 and include the drill bit 104 arranged at its distal end. The BHA 400 may further include a drilling component 402 arranged axially from the drill bit 104 and otherwise in a tandem relationship therewith. The drilling component 402 may be any tool or device used in drilling operations including, but not limited to, a steering unit, one or more stabilizers (concentric or eccentric), a mechanics and dynamics tool, a jarring tool, a sensor sub, a measuring-while-drilling (MWD) sub, a logging-while-drilling (LWD) sub, a turbine (with or without bend), a mud motor (with or without bend), combinations thereof, and the like. In at least one embodiment, the drilling component 402 may be a reamer, such as the reamer 106 of FIG. 1.

As the drill string 108 advances the BHA 100 into the subterranean formation 110, the drill bit 104 and the drilling component 402 synchronously rotate about corresponding central axes 404*a* and 404*b*, respectively. During drilling operations and rotation, the drill bit 104 and the drilling component 402 may further generate lateral unbalance forces, shown as cutting reaction unbalance force 406*a* for the drill bit 104 and mass unbalance force 406*b* for the drilling component 402. As with the cutting reaction unbalance forces 114*a,b* of FIG. 1, the unbalance forces 406*a,b* may be generated and act on the corresponding drill bit 104 and drilling component 402 in a lateral direction from each central axis 404*a,b*, respectively.

The unbalance forces 406*a,b* may urge the drill bit 104 and the drilling component 402, respectively, in corresponding lateral directions at particular angular orientations with respect to their corresponding central axes 404*a,b*. As a result of such reaction forces 406*a,b*, unwanted vibrations, inefficiencies, or damage may be introduced into the BHA 400, thereby reducing the effectiveness of the drilling operation.

According to the present disclosure, the adverse effects derived from the unbalance forces 406*a,b* being angularly offset from each other may be mitigated or otherwise minimized by manipulating the angular orientation of one or both of the drill bit 104 and the drilling component 402 after each has been coupled to (i.e., threadably engaged) the BHA 400. To accomplish this, in at least one embodiment, one or both of the drill bit 104 and the drilling component 402 may be arranged on or otherwise include a free-lock system (not shown), as generally described above with reference to FIG. 1. Once the desired angular orientation is obtained for each of the drill bit 104 and the drilling component 402, the free-lock system may be actuated to re-engage the drill string 108 such that simultaneous rotation is again enabled. In other embodiments, however, the actuation device 116 may be used to engage and disengage the drill string 108 such that the angular orientation of the drill bit 104 may be manipulated.

Unbalance force markings 408*a* and 408*b* may also be physically applied to the outer surfaces of the drill bit 104 and the drilling component 402, respectively. More particularly, the first unbalance force marking 408*a* corresponds to the angular orientation of the cutting reaction unbalance force 406*a* of the drill bit 104, and the second unbalance force marking 408*b* corresponds to the angular orientation of the mass unbalance force 406*b* of the drilling component 402. As discussed above, such angular orientations may be determined during the design phase of each tool, and the unbalance force markings 408*a,b* may be physically applied to each component during the manufacturing stage. The unbalance force markings 408*a,b* may be similar in nature and content to the unbalance force markings 302*a,b* of FIG. 3 and therefore will not be described again in detail.

The unbalance force markings 408*a,b* may prove useful in enabling well operators in the field to rapidly identify the angular orientation of the unbalance forces 406*a,b* for the drill bit 104 and the drilling component 402, respectively. Knowing these angular orientations will further allow well operators to properly orient the drill bit 104 with respect to the drilling component 402 once each is attached to the drill string 108, and thereby tailor a desired tandem unbalance force 410 that acts on the BHA 400 as a whole. In some embodiments, for example, the unbalance forces 406*a,b* of the drill bit 104 and the drilling component 402 may be generally angularly aligned.

In other embodiments, however, such as is depicted in FIG. 5, the unbalance forces 406*a,b* are arranged or angularly opposite from each other. As illustrated, the second unbalance force 406*b* is arranged angularly opposite the first unbalance force 406*b* (i.e., 180° angular offset), as indicated by the phantom second unbalance force marking 302*b* corresponding to the second unbalance force 406*b*. Again, for illustrative purposes of the description, the unbalance forces 406*a,b* are shown extending orthogonally to the left and right of the central axes 404*a,b*, respectively. Such unbalance forces 406*a,b*, however, actually extend orthogonally out of and into the page, respectively. Such embodiments may prove useful in minimizing the tandem unbalance force 410 acting on the BHA 400. More particularly, with the unbalance forces 406*a,b* acting in opposing angular directions, they may effectively cancel or substantially negate each other, thereby resulting in a smaller tandem unbalance force 410 acting on the BHA 400.

In yet other embodiments, it may be desired to place the unbalance forces 406*a,b* at an angular offset from each other lying somewhere between angularly aligned and angularly opposite each other. More specifically, a well operator may desire to place the unbalance forces 406*a,b* at an angular offset falling at a particular angle between 0° and 180°, without departing from the scope of the disclosure.

Accordingly, in the field, drill bits 104 and drilling components 402 may be selectively paired together by a well operator in accordance with the respective unbalance forces 406*a,b* as indicated on the corresponding unbalance force markings 408*a,b*. As a result, the well operator may be able to intelligently choose which drill bits 104 and drilling components 402 will work best in a tandem arrangement in the BHA 400.

Embodiments disclosed herein include:

A. A bottom hole assembly that includes a drill bit arranged at a distal end of a drill string and rotatable about a first central axis, the drill bit exhibiting a first unbalance force component that acts laterally on the drill bit and perpendicular to the first central axis at a first angular orientation, a first unbalance force marking physically applied to the drill bit and corresponding to the first angular orientation of the first unbalance force component, a tool arranged axially from the drill bit and rotatable about a second central axis, the tool exhibiting a second unbalance force component that acts laterally on the tool and perpendicular to the second central axis at a second angular orientation, and a second unbalance force marking physically applied to the tool and corresponding to the second angular orientation of the second unbalance force component, wherein an angular offset between the first and second unbalance force markings is able to be manipulated in order to obtain a desired tandem unbalance force between the first and second unbalance force components.

B. A method that includes determining a first unbalance force component for a drill bit, the first unbalance force component acting laterally on the drill bit and perpendicular to a central axis of the drill bit at a first angular orientation, applying a first unbalance force marking to the drill bit corresponding to the first angular orientation of the first unbalance force component, determining a second unbalance force component for a tool, the second unbalance force component acting laterally on the tool and perpendicular to a central axis of the tool at a second angular orientation, applying a second unbalance force marking to the tool corresponding to the second angular orientation of the second unbalance force component, arranging the drill bit and the tool in a tandem relationship on a bottom hole assembly, and manipulating an angular offset between the first and second unbalance force markings in order to obtain a desired tandem unbalance force between the first and second unbalance force components.

Each of embodiments A and B may have one or more of the following additional elements in any combination: Element 1: wherein the unbalance force component of the drill bit comprises a cutting reaction unbalance force. Element 2: wherein the first unbalance force component further comprises a combination of a cutting reaction unbalance force and a mass unbalance force. Element 3: wherein the tool comprises a tool selected from the group consisting of a reamer, a steering unit, a stabilizer, a mechanics and dynamics tool, a jarring tool, a sensor sub, a measuring-while-drilling sub, a logging-while-drilling sub, a turbine, and a mud motor. Element 4: wherein the second unbalance force comprises at least a mass unbalance force. Element 5: wherein the tool is a reamer and the second unbalance force component comprises a combination of cutting reaction forces and a mass unbalance force. Element 6: wherein at least one of the first and second unbalance force components are determined by combining a radial force vector and a drag force vector acting on the drill bit and the tool, respectively. Element 7: wherein the angular offset between the first and second unbalance force markings is minimized to obtain a maximized tandem unbalance force. Element 8: wherein the angular offset between the first and second unbalance force markings is maximized to obtain a minimized tandem unbalance force. Element 9: further comprising a free-lock system associated with at least one of the drill bit and the tool, the free-lock system being configured to disengage the drill bit or the tool from the drill string such that the first or second unbalance force markings may be angularly rotated until locating a desired angular orientation. Element 10: further comprising an actuation device arranged in the drill string between the drill bit and the tool and configured to adjust an angular orientation of the first unbalance force marking with respect to the second unbalance force marking. Element 11: wherein the first and second unbalance force markings are at least one of machined, welded, or cast into an outer surface of the drill bit and the tool. Element 12: wherein the first and second unbalance force markings are at least one of a sticker and an information plate physically attached to an outer surface of the drill bit and the tool. Element 13: wherein the first and second unbalance force markings include text used to identify the first and second unbalance force components, respectively.

Element 14: wherein the tool comprises a tool selected from the group consisting of a reamer, a steering unit, a stabilizer, a mechanics and dynamics tool, a jarring tool, a sensor sub, a measuring-while-drilling sub, a logging-while-drilling sub, a turbine, and a mud motor. Element 15: wherein the first and second unbalance force components comprise a combination of a cutting reaction unbalance force and a mass unbalance force. Element 16: wherein determining the first unbalance force component comprises calculating a radial force vector for the drill bit, calculating a drag force vector for the drill bit, and combining the radial and drag force vectors. Element 17: further comprising angularly aligning the first and second unbalance force markings to obtain a minimized tandem unbalance force. Element 18: wherein manipulating the angular offset between the first and second unbalance force markings comprises disengaging a free-lock system associated with at least one of the drill bit and the tool, and thereby rotationally freeing the at least one of the drill bit and the tool, angularly rotating the at least one of the drill bit and the tool until obtaining a desired angular orientation between the first and second unbalance force markings, and re-engaging the free-lock system once the desired angular is obtained, and thereby rotationally securing the at least one of the drill bit and the tool for tandem rotation. Element 19: wherein manipulating the angular offset between the first and second unbalance force markings comprises adjusting an angular orientation of the first unbalance force marking with respect to the second unbalance force marking using an actuation device arranged between the drill bit and the tool on the bottom hole assembly. Element 20: wherein applying the first and second unbalance force markings comprise at least one of machining, welding, or casting the first and second unbalance force markings into an outer surface of the drill bit and the tool, respectively, or physically attaching at least one of a sticker and an information plate to an outer surface of the drill bit and the tool.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A bottom hole assembly, comprising:

a drill bit arranged at a distal end of a drill string and rotatable about a first central axis, the drill bit exhibiting a first unbalance force component that acts laterally on the drill bit and perpendicular to the first central axis at a first angular orientation;

a first unbalance force marking physically applied to the drill bit and corresponding to the first angular orientation of the first unbalance force component;

a tool arranged axially from the drill bit and rotatable about a second central axis, the tool exhibiting a second unbalance force component that acts laterally on the tool and perpendicular to the second central axis at a second angular orientation;

a second unbalance force marking physically applied to the tool and corresponding to the second angular orientation of the second unbalance force component, wherein an angular offset between the first and second unbalance force markings is able to be manipulated in order to obtain a desired tandem unbalance force between the first and second unbalance force components; and at least one of a free-lock system and an actuation device arranged in the drill string to adjust an angular orientation of the first unbalance force marking with respect to the second unbalance force marking, wherein the free-lock system is associated with at least one of the drill bit and the tool and is operable to disengage the drill bit or the tool from the drill string such that the first or second unbalance force markings may be angularly rotated until locating a desired angular orientation, and wherein the actuation device is arranged in the drill string between the drill bit and the tool.

2. The bottom hole assembly of claim 1, wherein the unbalance force component of the drill bit comprises a cutting reaction unbalance force.

3. The bottom hole assembly of claim 2, wherein the first unbalance force component further comprises a combination of a cutting reaction unbalance force and a mass unbalance force.

4. The bottom hole assembly of claim 1, wherein the tool comprises a tool selected from the group consisting of a reamer, a steering unit, a stabilizer, a mechanics and dynamics tool, a jarring tool, a sensor sub, a measuring-while-drilling sub, a logging-while-drilling sub, a turbine, and a mud motor.

5. The bottom hole assembly of claim 4, wherein the second unbalance force comprises at least a mass unbalance force.

6. The bottom hole assembly of claim 1, wherein the tool is a reamer and the second unbalance force component comprises a combination of cutting reaction forces and a mass unbalance force.

7. The bottom hole assembly of claim 1, wherein at least one of the first and second unbalance force components are determined by combining a radial force vector and a drag force vector acting on the drill bit and the tool, respectively.

8. The bottom hole assembly of claim 1, wherein the angular offset between the first and second unbalance force markings is minimized to obtain a maximized tandem unbalance force.

9. The bottom hole assembly of claim 1, wherein the angular offset between the first and second unbalance force markings is maximized to obtain a minimized tandem unbalance force.

10. The bottom hole assembly of claim 1, wherein the first and second unbalance force markings are at least one of machined, welded, or cast into an outer surface of the drill bit and the tool.

11. The bottom hole assembly of claim 1, wherein the first and second unbalance force markings are at least one of a sticker and an information plate physically attached to an outer surface of the drill bit and the tool.

12. The bottom hole assembly of claim 1, wherein the first and second unbalance force markings include text used to identify the first and second unbalance force components, respectively.

13. A method, comprising:

determining a first unbalance force component for a drill bit, the first unbalance force component acting laterally on the drill bit and perpendicular to a central axis of the drill bit at a first angular orientation;

applying a first unbalance force marking to the drill bit corresponding to the first angular orientation of the first unbalance force component;

determining a second unbalance force component for a tool, the second unbalance force component acting laterally on the tool and perpendicular to a central axis of the tool at a second angular orientation;

applying a second unbalance force marking to the tool corresponding to the second angular orientation of the second unbalance force component;

arranging the drill bit and the tool in a tandem relationship on a bottom hole assembly; and manipulating an angular offset between the first and second unbalance force markings with at least one of a free-lock system and an actuation device arranged in the drill string and thereby obtaining a desired tandem unbalance force between the first and second unbalance force components, wherein the free-lock system is associated with at least one of the drill bit and the tool and is operable to disengage the drill bit or the tool from the drill string such that the first or second unbalance force markings may be angularly rotated until locating a desired angular orientation, and wherein the actuation device is arranged in the drill string between the drill bit and the tool.

14. The method of claim 13, wherein the tool comprises a tool selected from the group consisting of a reamer, a steering unit, a stabilizer, a mechanics and dynamics tool, a jarring tool, a sensor sub, a measuring-while-drilling sub, a logging-while-drilling sub, a turbine, and a mud motor.

15. The method of claim 13, wherein the first and second unbalance force components comprise a combination of a cutting reaction unbalance force and a mass unbalance force.

16. The method of claim 13, wherein determining the first unbalance force component comprises:

calculating a radial force vector for the drill bit;

calculating a drag force vector for the drill bit; and combining the radial and drag force vectors.

17. The method of claim 13, further comprising angularly aligning the first and second unbalance force markings to obtain a minimized tandem unbalance force.

18. The method of claim 13, wherein manipulating the angular offset between the first and second unbalance force markings comprises:

disengaging the free-lock system and thereby rotationally freeing the at least one of the drill bit and the tool;

angularly rotating the at least one of the drill bit and the tool until obtaining the desired angular orientation between the first and second unbalance force markings; and re-engaging the free-lock system once the desired angular is obtained, and thereby rotationally securing the at least one of the drill bit and the tool for tandem rotation.

19. The method of claim 13, wherein manipulating the angular offset between the first and second unbalance force markings comprises operating the actuation device to adjust an angular orientation of the first unbalance force marking with respect to the second unbalance force marking.

20. The method of claim 13, wherein applying the first and second unbalance force markings comprise at least one of machining, welding, or casting the first and second unbalance force markings into an outer surface of the drill bit and the tool, respectively, or physically attaching at least one of a sticker and an information plate to an outer surface of the drill bit and the tool.

* * * * *